US008701457B2

(12) United States Patent
Confalonieri

(10) Patent No.: US 8,701,457 B2
(45) Date of Patent: Apr. 22, 2014

(54) PROCESS AND APPARATUS FOR POSITIONING LAMINATIONS

(75) Inventor: Sergio Confalonieri, Cabiate (IT)

(73) Assignee: Ernesto Malvestiti S.p.A. (IT)

( * ) Notice: Subject to any disclaimer, the term of this patent is extended or adjusted under 35 U.S.C. 154(b) by 646 days.

(21) Appl. No.: 12/864,696

(22) PCT Filed: Feb. 20, 2009

(86) PCT No.: PCT/IB2009/000315

§ 371 (c)(1),
(2), (4) Date: Nov. 30, 2010

(87) PCT Pub. No.: WO2009/104084

PCT Pub. Date: Aug. 27, 2009

(65) Prior Publication Data

US 2011/0048095 A1 Mar. 3, 2011

(30) Foreign Application Priority Data

Feb. 21, 2008 (WO) ..... PCT/IT2008/000118

(51) Int. Cl.
*B21D 31/02* (2006.01)
*B21D 28/00* (2006.01)
*B21D 45/00* (2006.01)

(52) U.S. Cl.
USPC ..... 72/328; 72/336; 72/344

(58) Field of Classification Search
USPC ..... 72/324, 327–330, 333–337, 344–346
See application file for complete search history.

(56) References Cited

U.S. PATENT DOCUMENTS

| | | | | |
|---|---|---|---|---|
| 5,001,919 | A * | 3/1991 | Tuka et al. | 72/344 |
| 5,005,281 | A * | 4/1991 | Burns | 72/327 |
| 5,054,353 | A | 10/1991 | Haack et al. | |
| 6,065,322 | A * | 5/2000 | Tabata et al. | 72/334 |
| 6,163,949 | A * | 12/2000 | Neuenschwander | 29/521 |
| 8,166,636 | B2 * | 5/2012 | Malvestiti et al. | 29/732 |
| 2007/0271772 | A1 * | 11/2007 | Malvestiti et al. | 29/732 |

FOREIGN PATENT DOCUMENTS

| | | | |
|---|---|---|---|
| DE | 10019368 | A1 | 10/2001 |
| EP | 1859876 | A | 11/2007 |
| GB | 1278409 | A | 6/1972 |

* cited by examiner

*Primary Examiner* — Shelley Self
*Assistant Examiner* — Mohammad I Yusuf
(74) *Attorney, Agent, or Firm* — Hess Patent Law Firm LLC; Robert J. Hess

(57) ABSTRACT

The present invention concerns a process and an apparatus for positioning blanks in a tool provided with at least one die, at least one locating device for centring the lamination and at least one stripper element for separating the blank from the locating device. The locating device has an engaging portion having shape and dimensions so as to engage the contour of a centring hole placed inside the profile of the lamination obtained as final product and having the shape of a portion previously blanked.

8 Claims, 5 Drawing Sheets

PROCESS AND APPARATUS FOR POSITIONING LAMINATIONS

FIELD OF THE INVENTION

The present invention concerns a process and the relative apparatus for positioning blanks which are subject to subsequent steps of stamping and/or blanking, in particular for obtaining sheets and laminations in the production of electric motors.

BACKGROUND OF THE INVENTION

Stamping and/or blanking processes are traditionally used to produce a plurality of profiled blanks.

For example, it is known that some types of electric motors are produced by stacking a plurality of metal laminations. In particular, the stators and rotors of said motors are produced by packing a plurality of appropriately profiled ferromagnetic laminations. Generally the individual laminations are obtained from metal blanks which undergo stamping and blanking processes to obtain the required shape. The laminations thus obtained are coupled, in particular stacked, to form the core of a rotor or to form a stator.

The stamping and/or blanking processes are also used to produce other types of objects such as, for example, small gears, blanked pieces, computer cases, profiled parts etc.

Normally the stamping and blanking of blanks, also semi-finished products, are obtained by means of specific tools. The tools are provided with a die which, cooperating with a punch, performs the stamping of the blanks fed to the tool, or the blanking and the separation of the laminations. The punch is connected to a portion of the tool which moves vertically and alternatively on the blank, which remains positioned between the punch and the die. The forward movement of the blank is coordinated with the movement of the punch, so that each time the punch is lowered, new portions of the blank are intercepted by the punch and the die in order to be stamped or blanked. A tool for the production of metal laminations for electric motors is described, for example, in the European patent application EP-A-1859876 in the name of the Applicant.

Traditionally, the portion of the tool that supports the die is the lower stationary portion, while the portion of the tool that supports the punch is the upper portion, which is moved vertically with reciprocating motion. The upper portion of the tool is appropriately guided in its vertical movement so that the punch and the die are always correctly aligned.

The tools are generally provided with a device for guiding the upper portion of the tool with respect to the lower portion. The guide device comprises two or more "pillars", generally rigid rods connected to the upper (or lower) portion of the tool, which engage the lower (or upper) portion of the tool in a sliding manner.

When the punch is lowered to perform blanking of a portion of the blank, the pillar also moves vertically, engaging a distal end thereof with a seat purposely obtained in the lower portion of the tool, opposite the punch. In this way the guide device keeps the punch and the die centred during the stamping or blanking step. On the outer surface of the pillars, a plurality of revolving metal spheres can be provided which transform the sliding friction into rolling friction when the pillar fits into the corresponding seat obtained in the other portion of the tool.

The current tools can operate at high speed. For example the punch can be operated 300 times per minute. The precision of the guide device in aligning the two portions of the tool (upper and lower) is important to guarantee high quality and production standards.

In addition to the locating pillars, designed to guide the portions of the tool with respect to each other, modern tools are provided with locating devices to center the blank with respect to the die and relative punch. In other words, a locating device, or more simply "locator", has the task of correctly aligning the blank on the plane to ensure precise positioning with respect to the die and the punch.

Modern tools are also provided with a stripper element, i.e. a moving element, automatically operated, which has the task of facilitating separation of the blanked portion from the remaining portion of the same blank. The stripper element, which is different and separate from the locating devices, can have different forms, for example it can be generically cylindrical or tapered, and is connected to the upper portion of the tool, i.e. to the same portion where the punch is housed. The stripper moves with respect to the lower portion of the tool, on which the die is mounted, but it can also move with respect to the upper portion of the tool by means of appropriate mechanical actuators. The movement of the stripper element is synchronised with the movement of the upper portion of the tool.

U.S. Pat. No. 6,163,949 discloses in a detailed way the various steps of stamping and blanking of a blank for obtaining the laminations of stator and rotor of an electric motor. The positioning of the blank during its movement in the tool is performed by means of a plurality of circular driving holes in preset positions. In each stamping or blanking station of the tool, a circular pin, with a slight conical end, is inserted with interference in to the centring hole. In order to avoid that extraction of the pin, at the end of a stamping or blanking step, would raise the blank and therefore prevent the advancing thereof, a spring can be provided for exerting pressure on the same blank. The operation of a traditional tool during a metal lamination blanking cycle will now be described.

When the tool is open, i.e. when the upper portion is raised with respect to the lower portion, the blank is moved forward between the two above-mentioned portions. When the area of the blank to be blanked corresponds to the die, the upper portion of the tool is lowered towards the lower portion. Before the punch interacts with the relative die to blank a portion of the blank, the locator and the stripper element simultaneously engage with the blank to lock it in position, preventing lateral movements thereof. In this configuration the stripper acts as a retaining element for the blank.

Normally the locator has a cylindrical form, and the end that engages the sheet (a hole in the sheet) is slightly conical or flared on the lateral surface. Said end fits into a hole on the sheet undergoing the work process.

The blanking of the blank is completed by the punch which penetrates partially into the die. In a subsequent step, in which the tool is opened, the upper portion, the punch and the locator are raised with respect to the lower portion and the die, while the stripper remains lowered, for example in contact with the blanked portion or the remaining part of the blank. This prevents lifting of the blanked portion and/or the blank, and therefore facilitates separation of the locator with respect to the blank in order to allow the immediate advancing thereof.

Indeed, in order to allow a high accuracy of positioning, the locator has a dimension such as to engage the centring hole with a certain interference. If the stripper were not present, the blank could be raised together with the upper portion of the tool by the mechanical interferences that can occur between the locator and the centring hole in the blank undergoing the work process. When the upper portion of the tool has covered a pre-defined stroke in the lifting movement, the stripper is also raised together with it to re-set the tool to the open position, ready for a new blanking cycle. In traditional tools not provided with stripper, in order to avoid mechanical interference between the locator and the blank, the locator has a cylindrical form, normally with diameter smaller than the diameter of the centring hole. This solution prevents perfect centring of the blank since no mechanical interference is created between the locator and the centring hole of the blank.

Also in traditional tools provided with stripper, the locator does not permit high-precision positioning of the blank, i.e. centring of the blank is not always optimal. Indeed, positioning of the blank in each working station is always performed in the same hole and, due to the mechanical interference, deformations could take place in such a way that would cause low accuracy positioning because the reference is no longer univocal, in particular at the final working stations.

The partial insertion of a conical locator element in a circular centring hole which is remote from the portion undergoing to stamping and/or blanking could also cause undesired movements of the blank before reaching the correct centring.

Moreover, positioning of the blank moving from a station to another of the tool is not always optimal between the two upper and lower portions of the tool and intervention of the locator is of no help, as the lamination is retained by the stripper before the locator could perform the correct positioning of the blank.

SUMMARY OF THE INVENTION

The object of the present invention is to provide a process and relative equipment for the stamping and/or blanking of blanks which simply and effectively solve the drawbacks of the traditional solutions, at the same time permitting optimal centring of the blank, i.e. maximum positioning precision of the blank.

This and further objects are achieved by the present invention which concerns a process characterised according to claim 1.

The process according to the present invention is particularly suitable for positioning metal laminations, for example of the type used for producing electric motors, in a tool provided with at least one locating device and the relative stripper.

Although in the description below reference will be made mainly to the positioning for blanking laminations, the present invention can also be applied to the stamping of blanks, i.e. to the working which involve the forming of blanks, also without blanking.

The blank to be stamped and/or blanked is fed to a tool provided with at least one die, at least one locating device for centring the blank with respect to the die, and at least one stripper element for separating the blank from the locating device. The process according to the present invention substantially comprises the steps of:

- feeding a blank to the tool between the locating device and the die;
- centring the blank with respect to the die by bringing the locating device in engagement with at least one centring hole in the blank;
- closing the tool by approaching to each other the two portions forming the same;
- performing at least one operation of stamping and/or blanking on the blank;
- opening the tool by moving away to each other the two portions forming the same; and
- operating the stripper element to separate the blank from the locating device before further advancing the blank.

According to the present invention, the locating device has an engaging portion having shape and dimensions so as to engage the contour of the centring hole formed by the removal of a portion previously blanked from the blank. The centring hole is advantageously placed inside the profile of the lamination obtained as final product. This allows to position the blank always with high accuracy during each cycle by using as centring hole any portion already blanked previously with high accuracy and, in particular, inside the profile which will become the actual lamination, i.e. by reducing at the minimum any undesired movement that the blank could undergo in the area where a stamping or a blanking must be performed.

The stripper element preferably includes one or more portions adjacent to the locating device along its contour. This allows to prevent any deformation of the blank during the extraction of the locating device.

Preferably, in the same stamping and/or blanking cycle, the locating device engages with the blank in advance with respect to the moment when the stripper element engages the same blank.

In the specific case of blanking, the blank to be blanked is fed to the tool between the punch and the die. The blanking is performed by the punch which temporarily engages with the corresponding die, i.e. when the punch penetrates the die even only partially. Contrary to the traditional solutions, the locating device is operated to bring it into contact with the blank, i.e. engaging with one of its holes, before the punch has engaged the die even only partially. The interaction between the lateral surface of the locator and the edge of the hole of the blank determines shifting of the centring of the sheet, i.e. the axis of the hole on the sheet is moved to coincide with the axis of the locator. The stripper engages with the blank after the punch has been lowered against the surface of the blank, or simultaneously with it.

Advantageously this solution prevents the stripper from blocking the movements on the plane of the blank before it is blanked, and allows for fine centring of said blank for subsequent blanking.

In the traditional solutions, the stripper cuts in to block the blank before the locator can complete the centring. In other words, in the known solutions, the stripper is pressed against the blank before the locator performs the fine centring and before the punch is operated to perform the blanking.

According to the present invention, on the other hand, the stripper works only when necessary to facilitate separation of the portion of lamination already blanked. In the time interval between operation of the locator and actual blanking, the stripper does not in any way engage the lamination and therefore permits small centring movements of the lamination (fine centring). In other words, before the punch performs blanking of a portion of the blank, the latter can be moved into the tool to obtain the best possible centring.

During blanking of the lamination, i.e. when the punch penetrates the die even only partially, the stripper does not press against the lamination and does not act as a retaining element, and the locator prevents undesired movements of the lamination on the plane. In other words, the stripper and the punch intervene on the lamination only after fine centring has been completed and the locator prevents the latter from moving from the optimal position acquired.

A person skilled in the art will understand that the process according to the present invention can be implemented for the blanking of blanks not only made of metal but also of other materials, for example plastic.

Once blanking has been performed, the punch and the upper portion of the tool are raised to allow opening of the tool. The interference between the blank and the locator tends to maintain these elements engaged, and the stripper intervenes to finally separate the blank from the locator.

The positioning apparatus is included in a tool having two portions, at least one of which is movable with respect to the other. A first portion of the tool includes at least one locating device for centring the blank and at least one stripper element for separating the blank from the locating device. A second portion of the tool includes at least one die with respect to which the centring of the blank is performed.

The locating device of the apparatus according to the invention has an engaging portion having shape and dimensions so as to engage the contour of at least one centring hole formed by the removal of a portion previously blanked from the blank. Furthermore, the centring hole is placed inside the profile of the lamination obtained as final product.

The stripper element includes preferably one or more portions adjacent to the locating device along its contour.

For example, if the previously blanked portion, and therefore the centring hole, has a circular shape, the locating device could have a solid or hollow circular section, and the stripper element could have for example a shape of a circle ring which encompasses externally the locating device, or it can in the form of parts of a circle ring placed around the locating device.

The process according to the invention can be implemented with traditional equipment for the stamping and blanking of laminations, on condition that the actuators of the relative locators and strippers are modified and adjusted to adapt them to operating as described above.

The actuator member of the stripper, which can be, for example, a kinematic chain of several gears, is synchronised with the actuator members of the locator and/or the punch and the corresponding portion of the tool. The synchronisation is such that the locator engages a hole in the blank in advance with respect to the moment when the punch engages the corresponding die, and the stripper is operated at the moment when the punch engages the die or at a later stage.

In practice the locator also has the task of blocking the blank on the lower portion of the tool in the correct position and with maximum precision before the punch interacts with the relative die. Therefore in addition to correctly positioning the blank on the plane, the locator also serves as a retaining element for said blank in the centred position, i.e. it temporarily blocks the blank to prevent lateral movements thereof during blanking or stamping.

BRIEF DESCRIPTION OF THE DRAWINGS

Further aspects and advantages of the present invention will become clearer from the following description, provided for illustrative non-limiting purposes with reference to the accompanying schematic drawings, in which.

MODES FOR CARRYING OUT THE INVENTION

Figure 1:
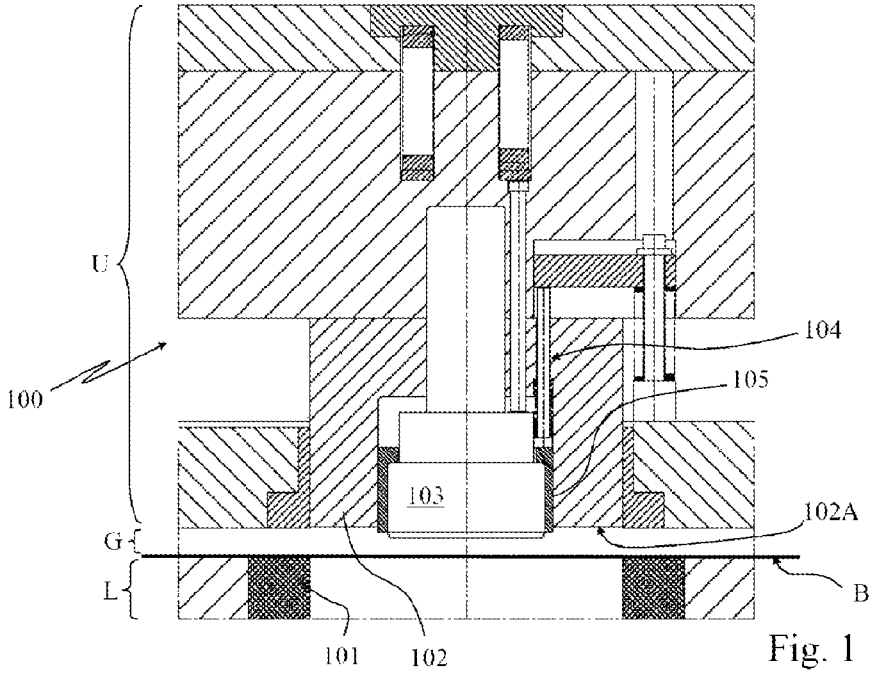
FIG. 1 is a cross section view, simplified, of a portion of a first tool according to the present invention, in a first configuration (open)

With reference to FIG. 1, a portion of a tool 100 according to the present invention is shown, provided with at least one die 101 and relative punch 102. Operation of the punch 102 and the die 101 is similar to operation of the corresponding elements of the tool described in the European patent application EP-A-1859876.

The die 101 is housed in the lower portion L of the tool 100, and the punch 102 is mounted on the upper portion U. The blank B to be blanked is fed between the upper portion U and lower portion L, in the gap G. Blanking is performed by the punch 102 which, when lowered, fits even only partially into the die 101, separating a portion of the blank B, of corresponding shape. After blanking a portion of the blank B, the punch 102 is raised. The punch 102 moves together with the upper portion A of the tool 100 with a reciprocating vertical movement, the frequency of which can exceed 300 strokes per minute.

The form of the punch 102 and of the die 101 can vary corresponding to the form of the portion to be blanked from the blank B, which can be for example a metal sheet. The tool 100 is particularly suitable for blanking ferromagnetic sheets for the production of laminations for electric motors, but can also be used in different sectors, for blanking blanks made of plastic, resin, etc.

In FIG. 1 the tool 100 is shown in a first configuration, i.e. open, with the upper portion U raised and distant from the lower portion L. In this configuration, a blank B, for example a coarse strip or a semi-finished product, is fed into the gap G. The blank B is supplied to the tool 100 by appropriate feed means, synchronised with the movement of the upper portion U of the tool. The blank, or sheet, or lamination B is positioned and blocked below the punch 102 and above the die 101 for blanking in one or more areas, the form of which corresponds to the impression of the punch and the die.

The tool 100 furthermore comprises a locating device 103 and relative stripper 105. The function of the locator 103 is that of performing fine centring of the blank B on, the relative plane. The stripper 105 has the function of facilitating separation between the blanked portion and the remaining portion of the sheet B.

The locator 103 is connected to one of the two portions of the tool 100. In the specific case shown in the attached drawings, the locator 103 is connected to the upper portion U of the tool. Preferably a counter spring is provided between the upper portion of the tool U and the locator 103.

The stripper 105 is positioned to the rear of the locator 103, for example outside the locator 103, and moves with the upper portion U of the tool, but also with respect to it, via appropriate actuator means schematised by 104.

The locator 103 can have different forms, generally corresponding to the form of the hole of the lamination B into which it fits, at least partially. In the first embodiment shown in FIGS. 1-3, the locator 103 is substantially cylindrical. FIG. 4 shows schematically (hatched area) the portion T1 blanked by the punch 102 which interacts with the die 101. The central area T2, circular, is the hole into which the lower end of the locator 103 fits, which in turn is preferably slightly tapered, or flared, to facilitate insertion.

Figure 2:
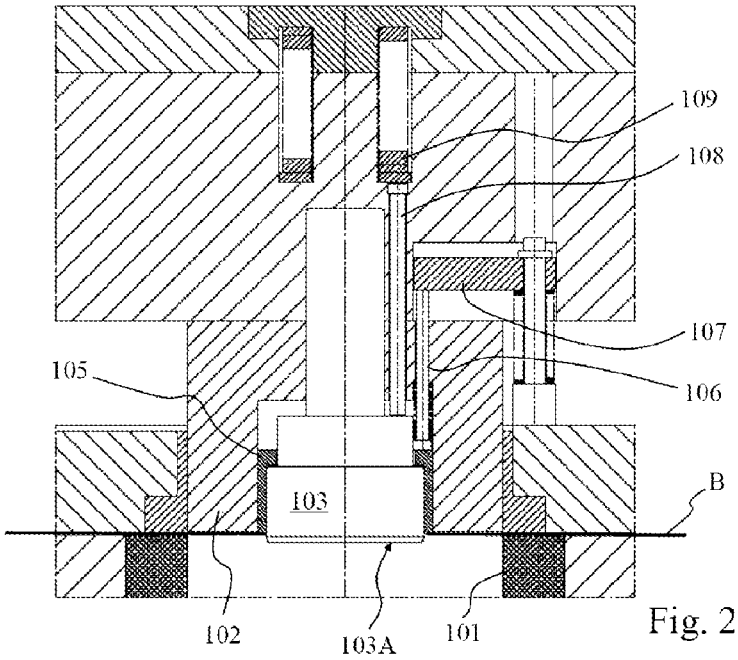
FIG. 2 is a partial section view of the tool of FIG. 1, in a second configuration (in contact)
Figure 3:
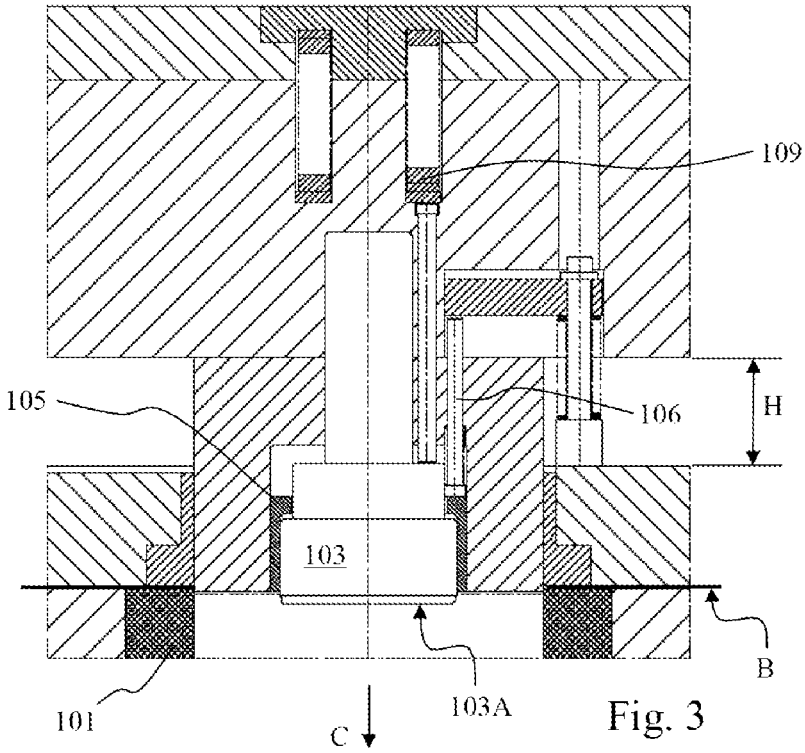
FIG. 3 is a partial section view of the tool of FIG. 1, in a third configuration (closed)
Figure 4:
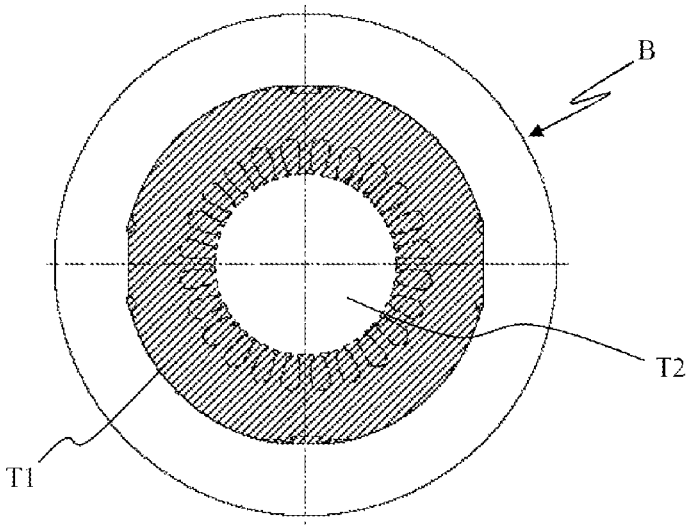
FIG. 4 is a top view of a blank undergoing the work process in the tool of FIG. 1.

With reference to FIGS. 1-3, a complete cycle will now be described for blanking of the blank B to form a lamination T1 having the shape shown in FIG. 4. It is assumed that the hole T2 has been made previously.

The actuator means 104 of the stripper 105 can be of the traditional type, for example comprising a kinematic chain consisting of screws, pins, cams, gears, etc. and/or combinations thereof. Preferably, as shown in FIG. 2, the actuator means 104 comprise a control pin 106 in turn controlled by an orthogonal actuator 107, a pin 108 controlling the locator 103 and the relative counter spring 109.

Initially the tool 100 is in a first configuration, open, as shown in FIG. 1. In this configuration a blank B is fed between the lower portion L and the upper portion U of the tool 100 and undergoes a first initial positioning, i.e. a first centring step is provided with respect to the axis of the die 101 and of the punch 102. The first centring step is preferably obtained traditionally, i.e. using for example mechanical centring elements provided on the upper portion U of the tool.

FIG. 2 shows the tool 100 in a second configuration, i.e. approached. The upper portion U is lowered to come into contact with the upper surface of the blank B positioned in turn on the lower portion L. The movement that shifts the tool from the first to the second configuration is a descending movement of the upper portion U. In this step the locator 103 moves integrally with the upper portion U. It should be noted that the lower portion 103A of the locator 103, designed to engage the hole T2 of the blank B, is slightly lowered with respect to the punch 102, i.e. it is at a lower level with respect to the lower surface 102A of the punch 102. When the upper portion U of the tool is lowered against the lower portion L, the locator 103, and in particular its portion 103A, is the first element to interact with the lamination B, fitting at least partially into the hole T2.

In other words, the locator 103 engages the lamination B in advance with respect to the stripper 105 and the punch 102. In other words, unlike the traditional solutions, the locator 103 interacts with the blank B undergoing the work process before the punch 102 has engaged said blank B, i.e. in advance with respect to when the lower surface 102A of the punch comes into contact with the blank B.

The process according to the present invention has the advantage of permitting a second centring step, more accurate than the first step described above, i.e. a fine centring, implemented before the punch 102 cooperates with the die 101, i.e. before the actual blanking begins. The fine centring of the blank B is obtained by engagement of said blank B with the locator 103, the diameter of which corresponds to the diameter of the hole T2.

The blank B, engaged by the locator 103, aligns on the plane in an optimal manner with respect to the die 101 and the punch 102 until the stripper 105 comes to rest on the blank, and prevents further movements on the plane. The stripper 105 moves in relation to the locator 103 in a vertical direction, and prevents raising of the blank. By anticipating the intervention of the locator 103 and delaying intervention of the stripper 105 with respect to the known art, as described above, a significant increase is obtained in long-term blanking precision, i.e. a high blanking repeatability with the required quality standards.

FIG. 3 shows the tool 100 in a third configuration, i.e. completely closed. The punch 102 is partially inserted in the die 101 and from the blank B a lamination corresponding to the area T1 shown in FIG. 4 has been blanked. The blanked portion falls into the empty space inside the die 101. With respect to the second configuration, the upper portion U of the tool 100 is further lowered to reduce the distance H indicated in FIG. 3, i.e. to favour a relative movement of the punch 102 with respect to the die 101.

Due to the mechanical interferences generated between the punch 102 and the blanked portion T1 of the blank B (for the sake of simplicity, FIG. 3 does not show the blanked portion T1 inside the die 101), this third configuration provides for the intervention of the stripper 105. The control pin 106 is operated to lower the stripper 105 to determine the final separation of the blanked portion T1 with respect to the remaining part of the blank B. The blanked portion T1 drops by gravity inside the die 101, in direction C.

In a step subsequent to the one shown in FIG. 3, the stripper 105 is kept in the position shown in FIG. 1. The tool 100 is opened to prepare for a new blanking cycle.

FIGS. 5-8 are relative to a second embodiment of a tool 200 according to the present invention. A person skilled in the art will understand that the tool 200 can be a tool separate and independent of the tool 100, or a work station previous or subsequent to the one shown in FIGS. 1-3 in relation to the first embodiment 100, i.e. a second work station in the same tool.

This embodiment 200 differs from the technical solution 100 shown in FIGS. 1-3 in several aspects, firstly the fact that there is no punch, since the tool 200 is not intended for a blanking operation but an intermediate centring operation between two blanking steps, or a stamping operation.

Figure 5:
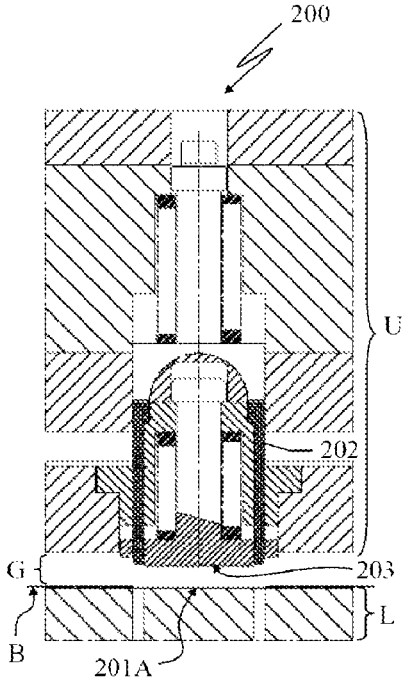
FIG. 5 is a cross section view, simplified, of a portion of another tool according to the present invention, in a first configuration (open)
Figure 9:
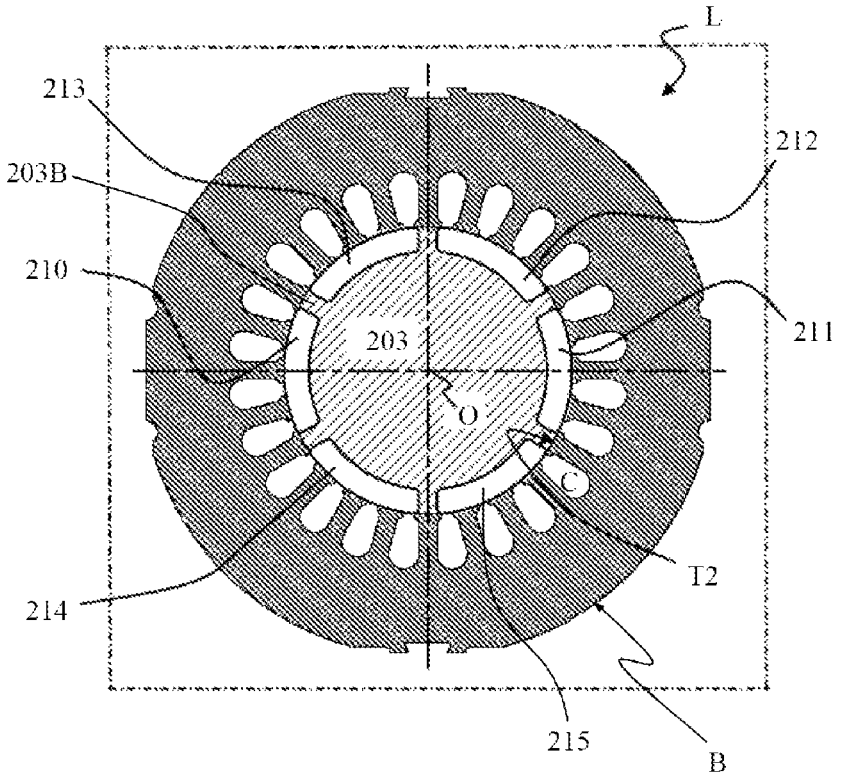
FIG. 9 is an overhead view of a blank undergoing the work process in the tool of FIG. 5.

With reference to FIG. 5, the tool 200 comprises a die 201 provided with recesses 210-215, each having the form of a circular sector which develops for a certain angle around the axis O of the die, designed to house corresponding portions of the locator 202. FIG. 9 shows the lamination B highlighted by a fine hatched area, positioned above the lower portion L of the tool 200 and in particular above the die 201, the seats 210-215 of which are indicated. The outer diameter of the seats 21-215 corresponds to the internal diameter of the hole T2 of the lamination B, i.e. the hole defined by the slots C.

Figure 6:
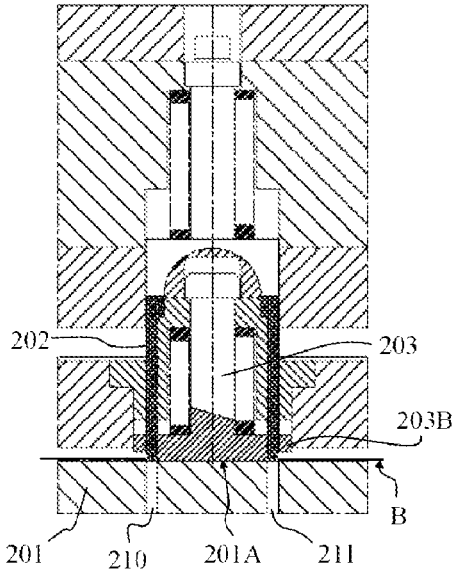
FIG. 6 is a partial section view of the tool of FIG. 5, in a second configuration (approaching)

The tool 200 shown in FIG. 5 is in a first configuration, open. Between the upper portion U and the lower portion L a gap G is provided which permits the insertion and positioning of a blank B, in an equivalent manner to the above description. FIG. 6 shows the tool 200 in a second configuration, with the upper portion U "approaching" the lower portion L, i.e. in a step in which the gap G is reduced. The blank B is positioned between the upper portion U and the lower portion L of the tool 200. The lamination B is positioned with the hole T2 aligned with the seats 210-215 of the die 201. The lower and central portion of the stripper 203 rests on the central portion 201A of the die 201, between the seats 210-215. In this step the portions 203B of the stripper 203 positioned between the seats 210-215 remain raised with respect to the lamination B, and therefore in the approach step the stripper 203 is not in contact with the lamination B.

From a comparison between FIGS. 5, 6 and 9 it can be noted that the central portion of the stripper 203, inside the locator 202, has a lower portion protruding downwards, i.e. towards the lower portion L of the tool 200. The portions 203B develop at a greater height, i.e. they remain raised with respect to the lower surface of the central portion of the stripper 203.

In the interval of time required to bring the tool 200 from the first configuration shown in FIG. 5 to the second configuration shown in FIG. 6, no operation is performed on the lamination B.

Figure 7:
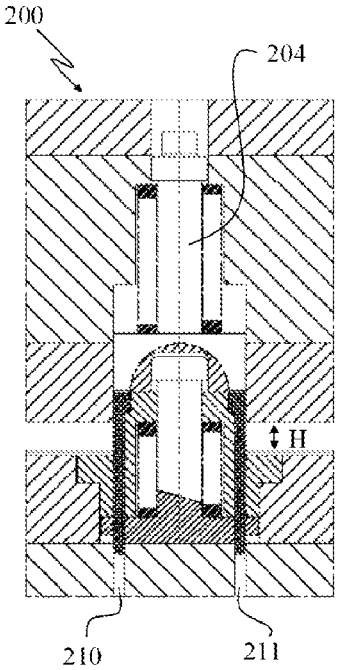
FIG. 7 is a partial section view of the tool of FIG. 5, in a third configuration (in contact)

Fine centring of the blank B is performed in the subsequent step shown in FIG. 7, when the two portions U and L of the tool 200 are completely in contact. The fine centring, which entails small movements of the blank B on the relative plane, is performed by the locator 202 which is inserted at least partially in the seats 210-215 in the die 201. Comparison between the FIGS. 6 and 7 highlights the downward movement of the locator 202, which fits into the seats of the die 201, and the reduction (but not the cancellation) of the gap G.

In this step, the outer surface of the locator 202 engages the inner edge of the hole T2 of the lamination B, determining the fine alignment thereof with the axis O of the die 201. To avoid harmful mechanical interference, the lower portions of the locator 202 are flared or slightly tapered.

Figure 8:
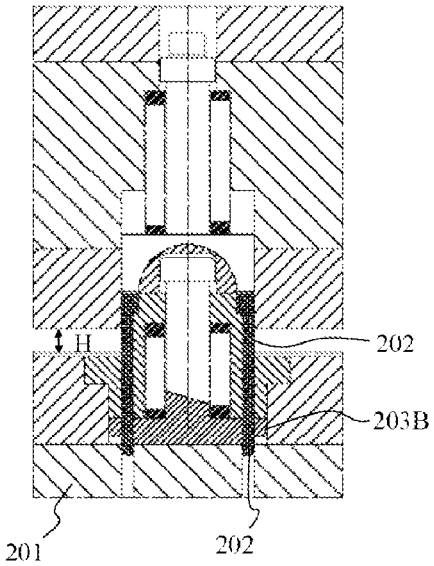
FIG. 8 is a partial section view of the tool of FIG. 5, in a fourth configuration (closed)

In the subsequent step, shown in FIG. 8, the tool 200 is definitively closed, i.e. the upper portion U is completely lowered against the lower portion L, cancelling the gap G. As can be seen by comparing FIGS. 7 and 8, the distance H is reduced due to the further lowering of the portion U of the tool 200 which closes on the lamination B. As described above, in the tool 200 no blanking of the lamination B is performed, only fine centring of said lamination B, already provided with the hole T2 and the slots C, with respect to the axis O shown in FIG. 9.

Subsequently to the closing shown in FIG. 8, the tool 200 re-sets to the configurations shown, in time sequence, in FIGS. 7, 6 and 5, so that it is ready for a new operating cycle.

In the upstroke step of the upper portion U, i.e. during the steps shown in sequence in FIGS. 7 and 6, the portions 203B of the stripper 203 intervene to prevent the lamination B from lifting up together with the locator 202 due to mechanical interference. When the portion U of the tool 200 is raised with respect to the portion L, relative sliding of the locator 202 occurs with respect to the portions 203B of the stripper 203. The locator 202 is raised with the portion U, while the stripper 203 remains initially in the lowered position. In this way the intermediate portions 203B between the circular sectors of the locator intervene to prevent raising of the lamination B.

The lamination B cannot therefore remain jammed on the locator 202 and the tool 200 re-sets to the open configuration shown in FIG. 5, ready for a new operating cycle.

The advantages of the process and equipment 100, 200 according to the present invention are evident. The lamination B undergoes a fine centring step before being locked in the tool 100, 200 for blanking or for other operations, thus maximising precision.

In addition to the embodiments shown on FIGS. 4 to 9, in which a circular centring hole is used, other embodiments can be adopted according to the present invention to perform centring of the blank.

Figure 10A:
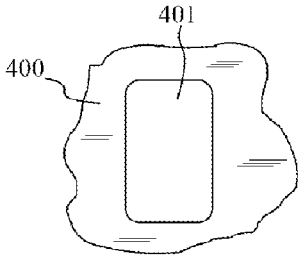
FIGS. 10A-10C show respectively the shape of a possible centring hole (FIG. 10A), and two embodiments (FIGS. 10B and 10C) of the locating device and stripper element for the same.

For example, FIG. 10A represents a blank 400 in which a portion of substantially rectangular shape, with rounded corners, has been previously removed inside the profile which will become the lamination obtained as final product. The free space 401 in the blank 400 can thus be used as centring hole for the engagement of a locating device 403 (FIGS. 10B and 10C) having the same shape of the centring hole 401.

Figure 10B:
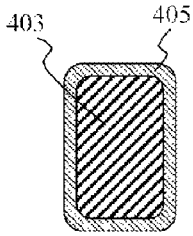
Figure 10C:
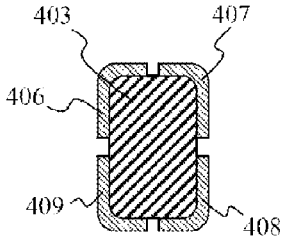

In the transverse section view of FIG. 10B the stripper element 405 consists of a single portion which encompasses completely the locating device 403. Alternatively, as shown in FIG. 10C, the stripper element can be made of a plurality of portions 406-409 which encompass the locating device 403.

Figure 11A:
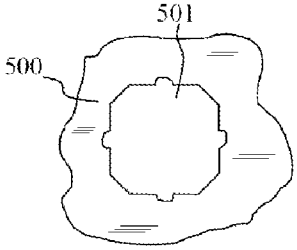
FIGS. 11A-11C show respectively the shape of another embodiment of a centring hole (FIG. 11A), and two embodiments (FIGS. 11B and 11C) of the locating device and stripper element for the same.

In FIG. 11A is shown a blank 500 in which another possible embodiment is represented for a window 501 previously obtained by blanking inside the profile which will become the lamination obtained as final product. The free space 501 in the blank 500 can thus be used as centring hole for the engagement of a locating device 503 as that shown in transverse section on FIGS. 11B and 11C, i.e. a locating device having the same shape of the centring hole 501.

Figure 11B:
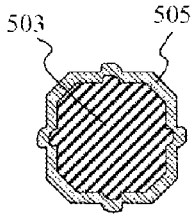
Figure 11C:
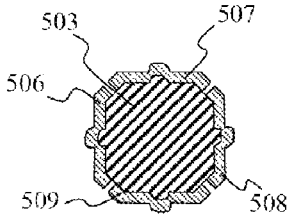
Figure 12A:
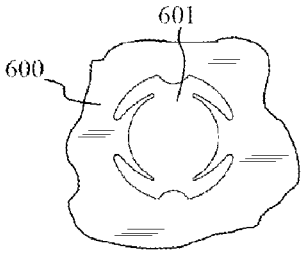
FIGS. 12A-12D are views of other possible shapes of blanked portions removed by blanks which can be used as centring holes for the locating devices and the relevant stripper elements of suitable shape.
Figure 12B:
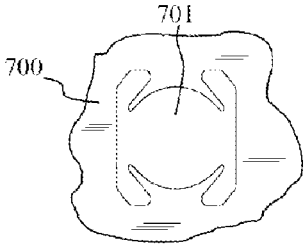
Figure 12C:
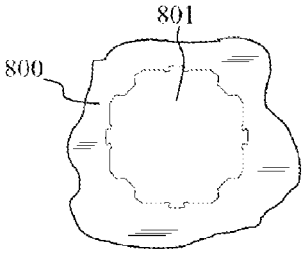
Figure 12D:
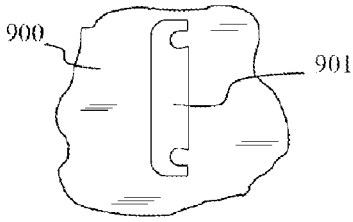

In the transverse section view of FIG. 11B the stripper element 505 consists in this case too of a single portion which encompasses completely the locating device 503. Alternatively, as shown in FIG. 11C, the stripper element can be made of a plurality of portions 506-509 which encompass the locating device 503.

FIGS. 12A-12D show for exemplary purpose some blanks 600, 700, 800 and 900 in which windows 601, 701, 801 and 901 of typical shape that can be found in the production of laminations for electrical motors have been previously obtained by blanking. The principles of the present invention are applicable to any form of the centring hole obtained inside the blank, also in case where the shape of the centring hole does not have central symmetry, as for example that identified with 901 in FIG. 12D.

The invention claimed is:

1. A process for positioning a blank (B) in a tool (100) having a first portion (U) including at least one locating device (103) for centering said blank (B), at least one punch (102) stamping and/or blanking a portion (T1) of blank (B), and at least one stripper element (105) for separating said blank (B) from said at least one locating device (103), and a second portion (L) including at least one die (101) with respect to which the centering of said blank (B) is performed, the process including the steps of:

feeding a blank (B) to the tool between said at least one locating device (103) and the die (101);

centering said blank (B) with respect to said die (101) by bringing said at least one locating device (103) into engagement with at least one centering hole in said blank (B) formed by removal of a portion previously blanked from said blank (B);

closing said tool (100) by approaching to each other said first portion (U) and said second portion (L);

performing at least one operation of stamping and/or blanking on said blank (B) with the at least one punch (102) by engaging the at least one punch (102) with the blank (B), bringing said locating device (103) into engagement with the at least one centering hole in said blank in advance of the at least one punch (102) engaging the blank (B);

opening said tool by moving away to each other said first portion (U) and said second portion (L); and operating said stripper element (105) to separate said blank (B) from said at least one locating device (103) before further advancing said blank (B), wherein said at least one locating device (103) has an engaging portion having shape and dimensions so as to engage a contour of said at least one centering hole, and in that said at least one centering hole is placed inside a profile of a lamination obtained as a final product.

2. The process as claimed in claim 1, wherein said at least one stripper element (105) includes one or more portions adjacent to said at least one locating device (103).

3. The process as claimed in claim 1 wherein, in said centering step, said locating device (103) engages with said blank (B) in advance of when said stripper element (105) engages said blank (B).

4. The process as claimed in claim 1, wherein the stripper element (105) engages with said blank (B) simultaneously with said punch (102) or at a later stage.

5. The process as claimed in claim 1, wherein said locating device (103) performs fine centering of said blank (B) before closing said tool.

6. The process as claimed in claim 5, wherein said locating device (103) performs said fine centering before said punch (102) comes into contact with said blank (B).

7. The process as claimed in claim 4, wherein said locating device (103) is operated to have movement synchronized with the portion (U) of the tool in which the punch (102) is housed.

8. The process as claimed in claim 4, wherein said blanked portion (T1) is continuous or formed of a plurality of separate portions.

* * * * *